US005628658A

United States Patent [19]

Clifford

[11] Patent Number: 5,628,658

[45] Date of Patent: May 13, 1997

[54] FLOTATION DEVICE UTILIZING CYLINDRICAL FOAM TUBES

[76] Inventor: Pater A. Clifford, 640 Unity Rd., Benton, Me. 04927

[21] Appl. No.: 568,963

[22] Filed: Dec. 7, 1995

[51] Int. Cl.[6] ..... B63C 9/08

[52] U.S. Cl. ..... 441/130

[58] Field of Search ..... 441/35, 40, 125, 441/126, 127, 128, 129, 130, 131, 132, 136; 114/283

[56] References Cited

U.S. PATENT DOCUMENTS 1,960,474 5/1934 Browne ..... 441/129

4,689,844 9/1987 Alivizatos ..... 441/129

*Primary Examiner*—Jesus D. Sotelo

*Attorney, Agent, or Firm*—William B. Ritchie

[57] ABSTRACT

A flotation device that converts an existing flexible round foam flotation piece into a floating seat for recreational and/or exercise purposes. The flotation device is water resistant, lightweight, flexible and easy to carry and store. The round flotation piece, commonly known as a noodle, is inserted through a sleeve in the flotation device wherein the floating seat then takes shape. Due to the flexible characteristics of the invention, a wide range of body shapes and sizes provide a comfortable and stable flotation aid that allows the user to remain mostly submerged in the water with unrestricted movement of the arms and legs. In addition to the floating chair concept, other configurations utilizing the round flotation piece are possible by utilizing a reconfigured attachment device. For example, a flotation device can be made to form a floating raft by using a plurality of sleeves to mate with three round flotation pieces.

10 Claims, 6 Drawing Sheets

FLOTATION DEVICE UTILIZING CYLINDRICAL FOAM TUBES

BACKGROUND OF THE INVENTION

1. Field of the Invention

The invention relates to water flotation devices designed to support a human for recreational and/or exercise purposes.

2. Description of the Related Art

There are several types of flotation devices for the pool and other various types of bodies of water. These devices typically include floating chairs, inflatable rafts, inner-tubes and large rigid foam pieces.

These flotation devices are cumbersome, rigid and limit one's movement in the water. For instance, devices requiring inflation necessitate the need for either an external air pump or a person to manually inflate the device with air from their lungs. This proves to be cumbersome and in the latter case, exhausting. Once the device is inflated, pin hole leaks can develop which allow air to escape causing them to deflate and gradually become less effective in their continued use, at which point the flotation device must either be re-inflated or the hole must be patched. Other drawbacks to existing floatational devices are that they hold the majority of one's body above the surface of the water which reduces the effect of the water on the body. This would allow one's body to become very hot while also greatly reducing the movement of the body for propulsion and/or exercise purposes.

U.S. Pat. No. 5,307,527, issued to Schober on May 3, 1994, discloses a pool chair adapted to be partially submerged in a swimming pool. The chair is designed to rest along the perimeter of the pool so that it is held in an upright, stationary position in order to allow a user to sit on the seat with the user's lower torso and legs submerged in the water while the user's head is above the water. Not withstanding the fact that the pool chair overcomes the limitation of holding the majority of one's body above the surface of the water, nonetheless, it is accomplished with a cumbersome and rigid construction which limits one's mobility throughout the pool due to the chair's dependency on the edge of the pool.

With respect to inner-tube type recreational devices, U.S. Pat. No. 5,295,885, issued to Karl on Mar. 22, 1994, discloses an attachable/detachable hammock-like seat designed to engage the central opening of the inner-tube to support users as they sit across the inner-tube's central opening. A user's head, arms and shoulders are over one end of the tube, with the feet over the other end. Unlike the Schober patent, this invention holds the majority of one's body above the surface of the water. In addition, the inflatable inner-tube device is subject to pin hole leaks which would allow air to escape, thus presenting a problem to the user; either re-inflate the inner-tube or patch the hole for continued use.

It would be an improvement on the current art to create a flotation device that is not cumbersome, rigid or limits one's movement in the water while holding the majority of one's body below the surface of the water. A benefit of holding one's body below the surface of the water would be to increase the effect of the water on the body such as preventing one's body from becoming very hot and to also increase the movement of the body for propulsion and/or exercise purposes. A device that overcomes the shortcomings as just described for a flotation device is not disclosed in the prior art.

SUMMARY OF THE INVENTION

It is an aspect of the invention to provide a flotation device to form a floating seat that is adaptable to a cylindrical foam water flotation toy that can be easily inserted for use and that can be easily removed for storage.

It is another aspect of the invention to provide a flotation device to form a floating seat that overcomes the problem of air leaks.

It is another aspect of the invention to provide a flotation device that can utilize readily available ETHAFOAM or similar closed cell cylindrical foam flotation materials such as products sold under the trademark WATER NOODLE.

Another aspect of the invention is to provide a flotation device that can utilize the commercially available WATER NOODLE or similar products and incorporate them into the flotation device without requiring cutting or otherwise altering the WATER NOODLE.

It is another aspect of the invention to provide a flotation device such as a seat or raft that is flexible to accommodate a wide variety of body shapes and sizes.

It is another aspect of the invention to provide a flotation device that forms a floating seat which provides the user with a range of body positions from sitting upright to supine.

It is another aspect of the invention to provide a flotation device that forms a floating seat that allows unrestricted use of a user's arms and legs for propulsion and exercise purposes.

It is another aspect of the invention to provide a flotation device that forms a floating seat that allows the user's body to float while being mostly submerged in the water, thereby obtaining an even greater cooling effect on the user.

It is another aspect of the invention to provide a flotation device that forms a floating seat having excellent stability to accommodate user comfort.

It is another aspect of the invention to provide a flotation device that can be mass produced using readily available material.

It is another aspect of the invention to provide a flotation device that is durable and long lasting.

Another aspect of the invention is to provide a floatation device that is very easy to get into and out of.

It is still another aspect of the invention to provide a flotation device that can be easily stored compact yet readied for use without the need for filling the device with air.

It is another aspect of the invention to provide a flotation device that is inexpensive to produce.

It is another aspect of the invention to provide a flotation device that is lightweight yet sturdy.

It is a final aspect of the invention to provide a flotation device that is inherently buoyant due to the insertion of one or more cylindrical tubes of a closed cell foam.

The invention is a flotation device that comprises a flexible fabric having at least one sleeve whereby a positive flotation cylinder of foam can be easily inserted thus rendering the device with sufficient buoyancy to float a user of average size and weight. The flexible fabric can be fashioned in a variety of shapes such as a chair or a raft. When shaped as a chair, the flexible fabric further comprises a bottom seat and a seat back such that the floating chair configuration takes shape when the pieces are joined together. In addition, a sleeve is provided. The sleeve having a hollow interior is preferably cut out separately. However, the sleeve could be made from the seat back by folding the uppermost portion of the sleeve end of the seat back over and securing to a predetermined position on the seat back. This provides a hollow interior and allows a cylindrical foam piece to be inserted to form the floating chair configuration. The flotation device comprises a material that is flexible and water resistant. When the flexible material is configured as a raft, a plurality of sleeves is provided such that sufficient buoyancy is obtained to float an average sized and weight user at a comfortable position in the water.

DETAILED DESCRIPTION OF THE INVENTION

Recently, a new water toy has found its ways to beaches and swimming pools that even adults found fun to use. The WATER NOODLE and its progeny is a foam cylindrical tube, approximately 2⅝ inches in diameter and about 64 inches long, that is used to provide a swimmer with positive flotation. Most of the products are made from ETHAFOAM, the closed cell foam manufactured by Dow Chemical, or other closed cell foam that can provide positive flotation and withstand the rigors of children using it as a toy.

It was recognized by the inventor that this device could be used for the construction of commonly used water flotation devices such as a chair or a raft. By enabling the use of foam tubes to provide buoyancy, the resulting structures were immune from the effects of pin-hole punctures. Given the inherent durability of ETHAFOAM, only severe punishment might result in some of the foam material tearing loose. In fact, this type of foam is approved by the U.S. Coast Guard for use in life vests due to excellent buoyancy and durability properties.

Figure 1:
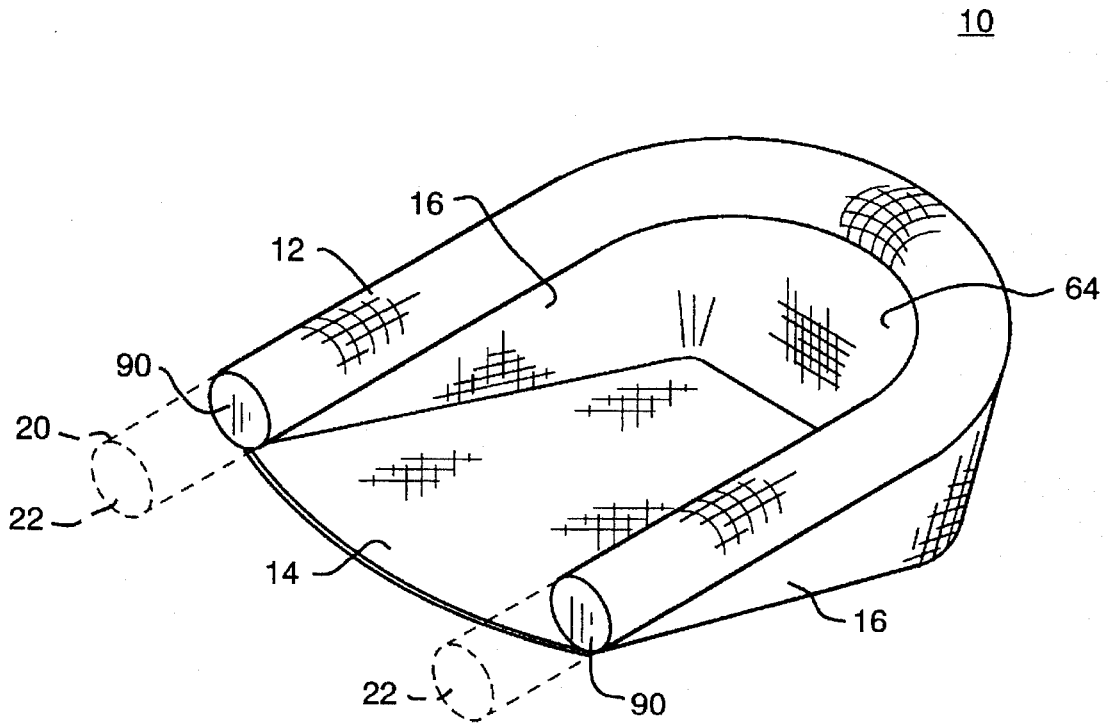
FIG. 1 is a perspective view of the flotation device fitted with a cylindrical foam tube to form a floating seat.

FIG. 1 is a perspective view of the preferred embodiment of the flotation device 10 fitted with a single foam tube 20 to form a floating seat. Other configurations of device 10 are addressed below. Furthermore, other conceivable variations not included in this specification using in combination a reconfigured flotation device 10 and one or more foam tubes 20 are within the scope of the invention.

Flotation device 10 is preferably made out of a water resistant mesh material that is lightweight while allowing for flexibility and strength. A polyester mesh material is preferable because of its availability, cost and resistance to UV light and pool chemicals. A close hole pattern of about ⅛ inches is preferred to avoid accidental catching of bathing suit buttons, fingers, etc. However, other materials such as canvas or nylon, that can be easily fabricated into shapes disclosed herein and are suitable for use in marine environments would be acceptable.

Foam tube 20 is inserted into preformed sleeve 12 through opening 90. Sleeve 12 is sized to allow easy insertion of piece 20 which is to be inserted until both ends 22 are extending out from opening 90 at approximately equal distances while forming a general U-shape. Undersizing the length of sleeve 12 compared to tube 20 also accounts for variations in length of tube 20 that may occur from brand to brand. The dimensions of sleeve 12 are not critical but should be sized so that tube 20 can be easily inserted and removed, even when device 10 is wet. The preferred diameter of sleeve 12 is approximately 3 inches with the total length less that the usual length of a typical tube 20 such that several inches of tube 20 extend equidistantly on either side of device 10.

Figure 5:
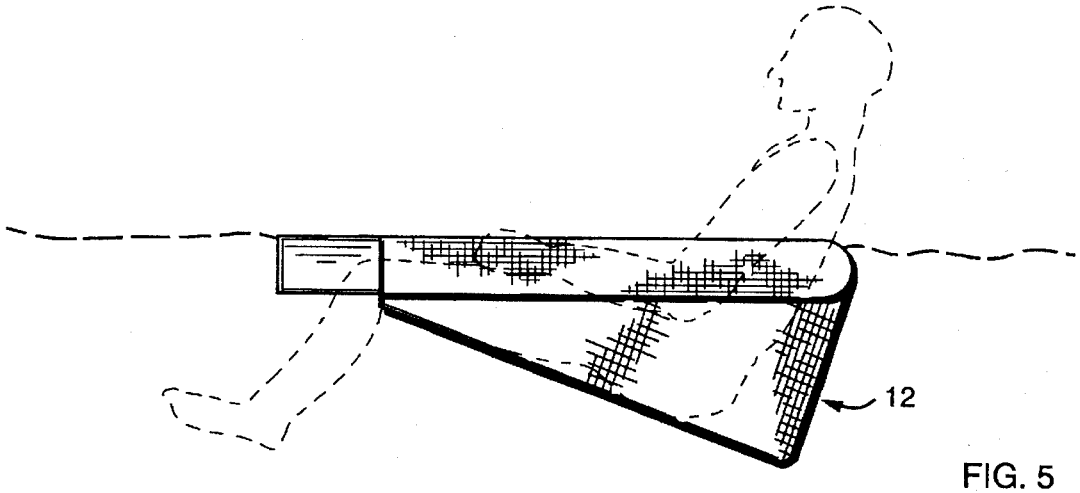
FIG. 5 is a side view of the flotation device in use supporting a bather.
Figure 6:
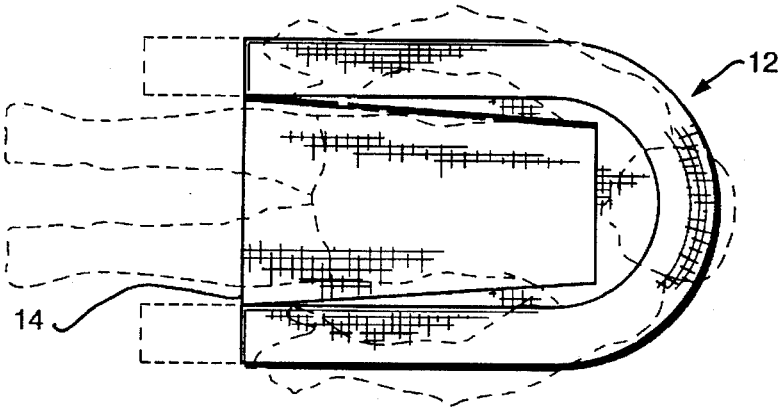
FIG. 6 is a top view of the flotation device in use.
Figure 7:
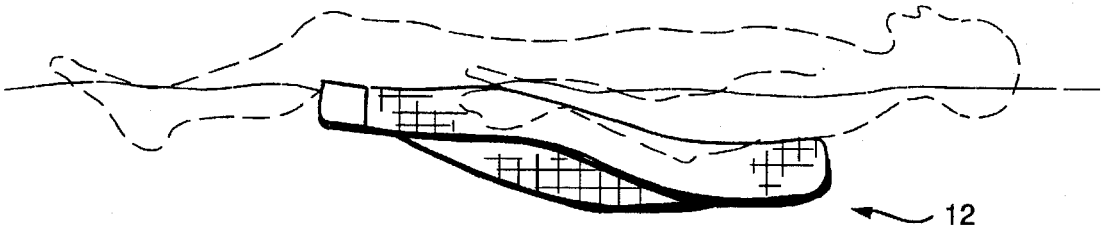
FIG. 7 is a side view of the flotation device showing an alternative position of the user floating with the device.

Seat bottom 14 prevents spreading of floatation device 10 by holding sleeve 12 in a U-shaped pattern, which in turn holds flotation device 10 in the same U-shaped pattern because of its general U-shape configuration. Once the chair is formed and placed in the water, the user can then sit in device 10 as if it were a chair as shown in FIGS. 5 and 6. In addition to using the device in an upright position, the user may also lay on the top of invention 10 in a supine position and still be supported as shown in FIG. 7. Referring to FIG. 5 and 6 again, while in an upright position, the user has unrestricted use of arms and legs for propulsion and/or exercise purposes because device 10 allows the user's body to float while being mostly submerged in the water.

Figure 2:
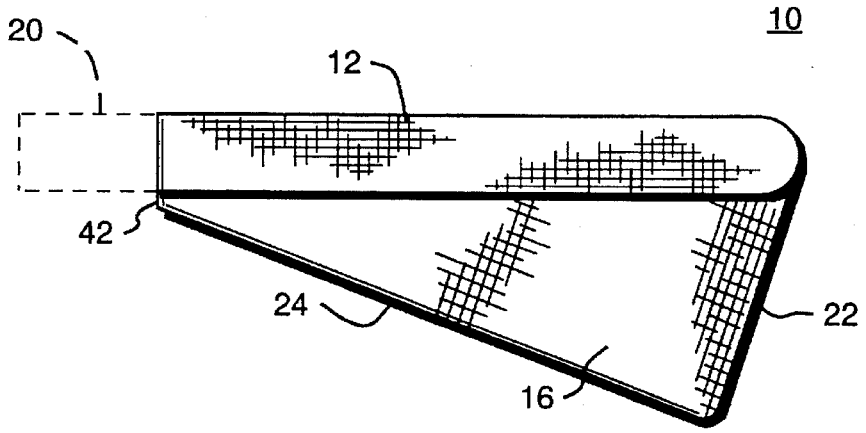
FIG. 2 is a side view of the flotation device.

FIG. 2 is a side view of the flotation device 10 fitted with foam tube 20 to form a floating seat. With respect to sides 16 of seat back 64 (shown in FIG. 1), the depth of edge 22 in relation to edge 42 is selected so that the user's knees are slightly above the buttocks when positioned in the water. This position allows the user's body to bend in its natural places providing comfort while also placing the body's center of gravity in a desirable location for stability. Edge 24 represents where side 16 and seat bottom 14 are joined together. The length of edge 24 is selected to permit the user's knees to hang over the front section of seat bottom 14 while the user's backside is resting against seat back 64. The flexible characteristics of the material used in construction allow invention 10 to accommodate a wide variety of body shapes and sizes. Edge 24 is preferably about 20 inches; edge 22 is preferably about 14 inches; edge 42 is preferably about 1 inch; front edge of seat 14 is preferably about 24 inches; and the back edge 25 is preferably about 14 inches. However, these dimensions are not critical and can be changed substantially without adversely affecting the overall performance of the device.

Figure 3:
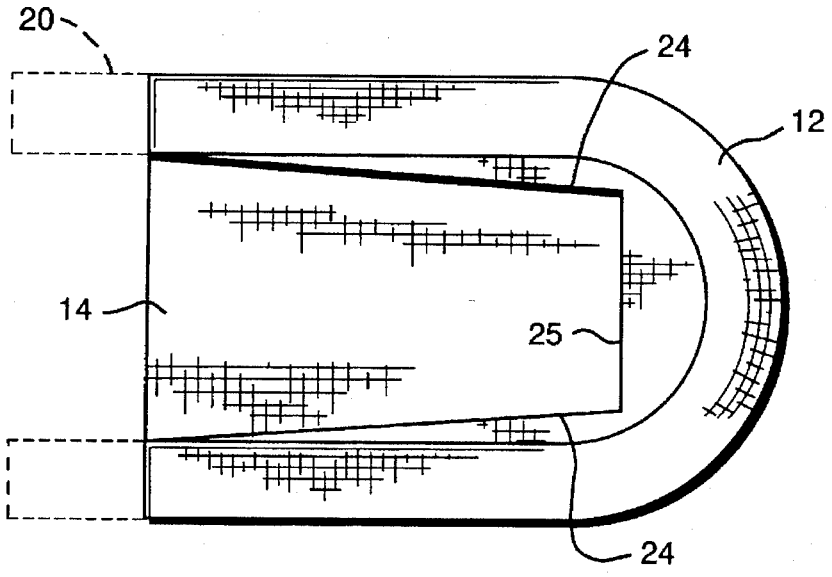
FIG. 3 is a top view of the flotation device.

FIG. 3 is a top view of attachment device 10 fitted with tube 20 to form a floating seat. As viewed from this position, seat bottom 14 is generally of a trapezoid shape. A trapezoid shape allows seams 24 and 25 to be attached in a straight seam, thus permitting easier assembly. The U-shape dimensions of invention 10 allow foam piece 20 to naturally conform to the user's sides and provides a buoyant support located between the mid to upper back of the user.

Figure 4:
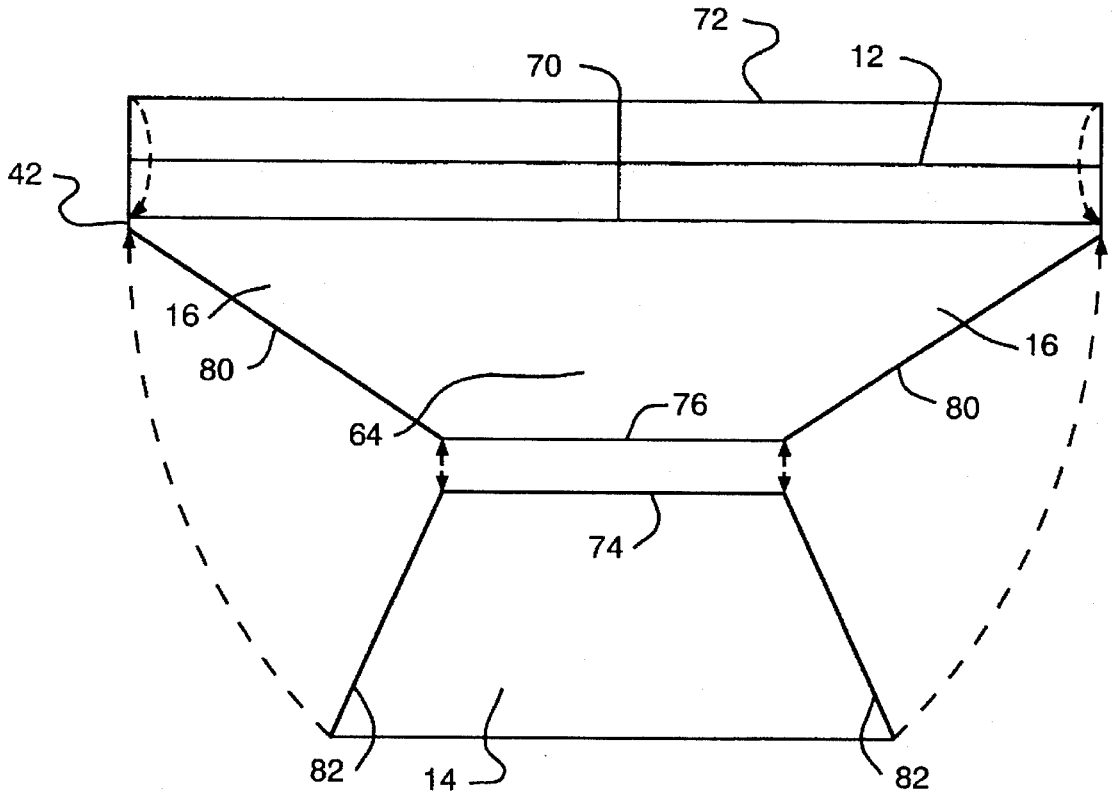
FIG. 4 is an unassembled view of the flotation device.

FIG. 4 is an unassembled view of attachment device 10. Device 10 is preferably made up of three pieces; seat bottom 14, sleeve 12, and seat back 64. However, seat back 64 has two sides 16 extending from it. Sleeve 12, as an alternative method may be part of seat back 64 section. In other words, sleeve 12 could be formed out of the material extending from the top of seat back 64. To form sleeve 12, side 72 is joined with side 70 and then sewn in place with binding tape. Preferably, all sewn seams as well as all edges use binding tape to ensure durability. Likewise, side 76 is joined with side 74 and then sewn in place. The remaining two sides to be joined together and sewn are sides 80 with sides 82. This completes the construction of attachment device 10 so that foam piece 20 is now ready to be inserted through sleeve 12 to form the floating chair. The preferred method of sewing is to use a folding attachment that folds the edges together and covers the edges with binding tape that is also folded over the edge by use of the folder. A polyester thread such as a 90 series type is preferred. This type of thread is frequently used to stitch together luggage. A close locked stitch using 8 stitches per inch provides a good solid seam. Acceptable alternatives to sewing would be heat sealing, gluing and ultrasonic fusion.

Figure 8:
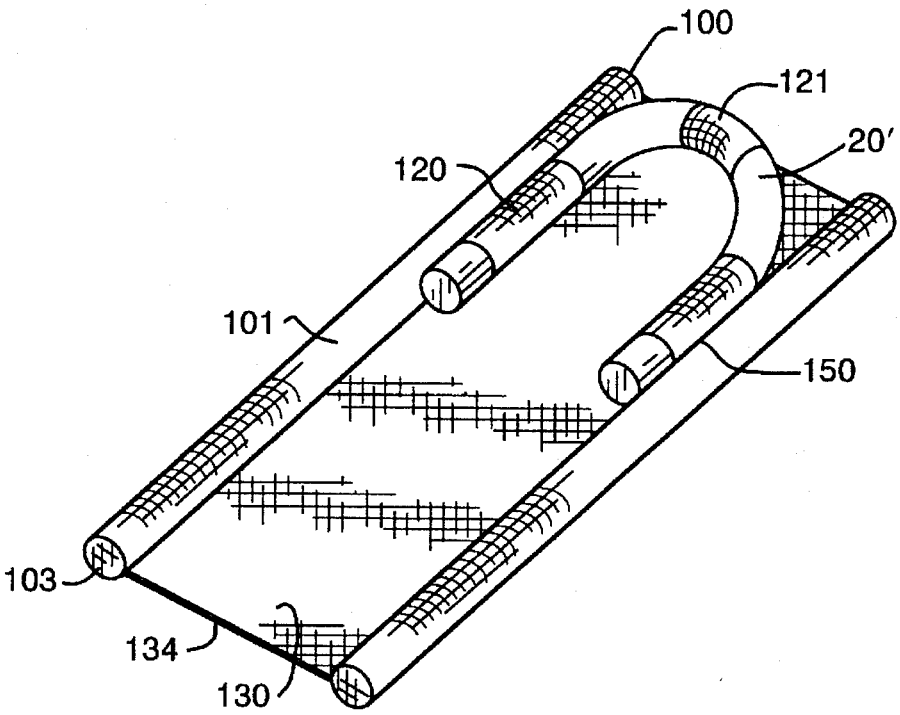
FIGS. 8 is a perspective view of an alternative embodiment of attachment device fitted with a plurality of cylindrical foam tubes to form a floating raft.
Figure 8A:
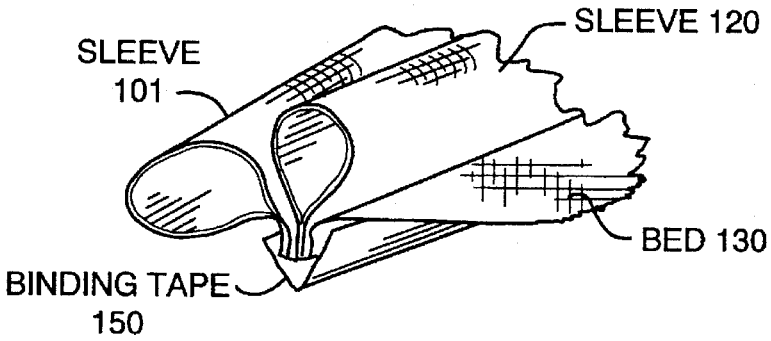
FIG. 8A, C show details of the construction method used to make the flotation device.
Figure 8C:
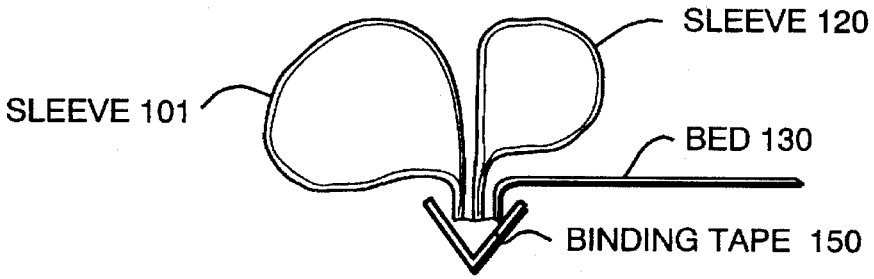
FIG. 8*b* is a detail of an alternative embodiment to the headrest sleeves.
Figure 8B:
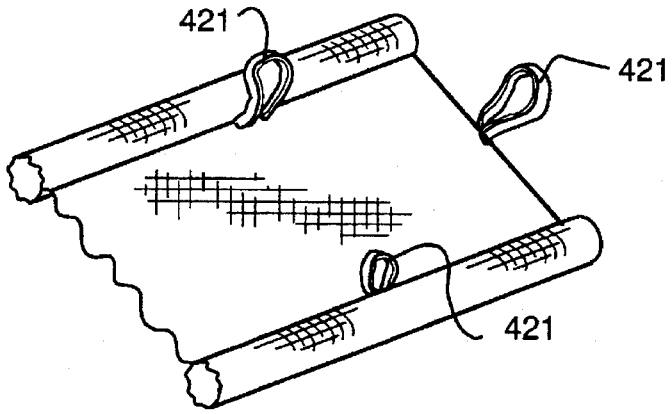

FIG. 8 is a perspective view of an alternative embodiment of device 10 fitted with a plurality of cylindrical foam tubes 20 to form a floating raft. Two of the three foam pieces 20 are not visible because they are inserted through openings 100 of float sleeves 101. Ends 103 of sleeves 101 are enclosed to prevent foam tubes 20 from being inserted too far through sleeves 101. Foam tube 20' is used in its full length as a headrest pillow and is bent in order to insert through headrest sleeves 120. Head rest sleeves 120 are approximately 12 to 18 inches long and are sized to allow easy insertion of foam piece 20. Optional headrest sleeve 121 can be used to held hold foam tube 20' in place and keep it within sleeves 120. Positioning of headrest sleeves 120 allows bend 21 to be approximately even with end 132 of floating bed 130. Furthermore, headrest sleeves 120 are attached to float sleeves 101 and float bed 130 with the use of binding tape 150. All sleeves are cut out individually. As shown in FIGS. 8A, C, sleeve 101 is cut into a piece approximately 11 by 68 inches. This piece is folded and run through a folder attachment on sewing machine at the same time as bed portion 130, thereby connecting the two pieces. As the progression up the edge occurs, sleeve 120 is inserted in its desired location with binding tape 150. Rather than use sleeves 120 and 121, loops 421 could be substituted as shown in FIG. 8B. Preferably binding tape 150 is the type manufactured by Bechik Products, Inc. The 1¼ inch tape provides a finished edge that is approximately 11/16 of an inch. This type of tape is frequently used in the mattress industry to provide the edges of a mattress. This tape is very durable with a high strength to weight ratio. The binding tape is applied by an automatic feed attachment that is fastened to the sewing machine. The mesh material and binding tape are folded together and stitched in one motion. These sewing techniques are well known in the art.

Float bed 130 is approximately equal in length to foam tube 20, that is about 64 inches long. The width of floating bed 130 is wide enough to allow for a wide range of body shapes and sizes, preferably about 22 inches. This size of device 10 provides a comfortable and stable flotation aid for most people. Binding tape is applied along top end 132 and bottom end 134 as protection for the mesh material used in the construction of attachment device 10.

Floating sleeves 101 are approximately equal in length to foam tube 20. Sleeves are separate pieces of material and are sized to allow for easy insertion of foam tube 20 as in the preferred embodiment. Floating end caps 103 are part of floating sleeves and are necessary to prevent foam tubes 20 from sliding completely through after being inserted through opening 100. Likewise, binding tape 150 is used to secure floating sleeve 101 to floating bed 130. Also, binding tape 150 is used to enclose endcap 103.

Figure 9:
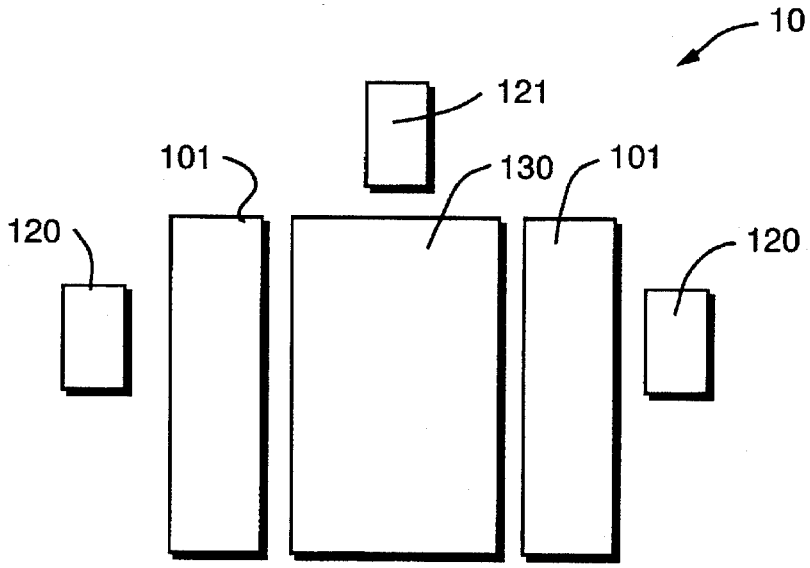
FIG. 9 is an unassembled view of the alternative embodiment of the flotation device.

FIG. 9 is an unassembled view of the alternative embodiment of the flotation device 10. Device 10 in this configuration is made up of six pieces; floating bed 130, a left and right floating sleeve 101, and a left, right floating sleeve 120 and optional top sleeve 120'. The six pieces are all attached with binding tape 150.

Figure 10:
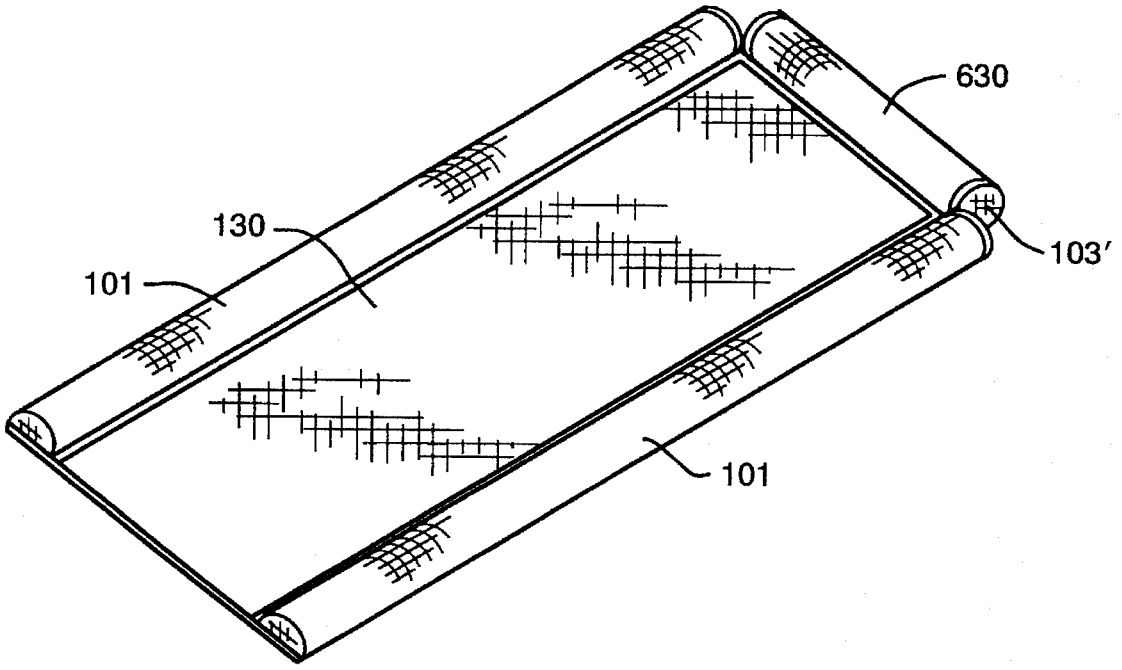
FIG. 10 is an assembled view of a variation of the alternative embodiment of the floatation device shown in FIG. 8.

FIG. 10 is an assembled view of a variation of the alternative embodiment of the floatation device shown in FIG. 8. In this embodiment, which is preferable with respect to simplicity of manufacture and user comfort, bent foam tube 20' is eliminated. However, a user would have to cut a foam tube 20 to fit sleeve 630 which is approximately 22 inches. Sleeve 630 is also fitted with end cap 103' which functions the same as floating end caps 103.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A flotation device used to form a chair-shaped flotation aid for supporting a user, said flotation device using a cylindrical foam tube having a length much greater than its diameter, said device comprising:

a flexible fabric comprising a first section of sleeve and a second section of sleeve, wherein said first section and said second section have a predetermined alignment with respect to one another;

said flexible fabric further comprising:

a seat section having a front end and a back end, and two side ends, wherein the back end and the two side ends of said seat section are attached to said first and second sections of sleeve, such that inserting said cylindrical foam tube into said sections of sleeve of said flexible fabric causes said cylindrical foam tube to be curved forming said seat section into a chair-shaped flotation aid which provides support for a portion of the user's body.

2. The flotation device of claim 1 wherein the shape of said bottom seat is a trapezoid shape to allow straight seams for assembly and assembly ease.

3. The flotation device of claim 1 wherein said flexible fabric further comprises a material that is water resistant.

4. A flotation device used to form a flotation aid using at least two cylindrical foam tubes, each foam tube having a length that is much greater than the diameter, said device comprising:

a float bed of flexible fabric having a left side and a right side; and a floating left sleeve attached to the left side of said float bed wherein a left cylindrical foam tube can be inserted; and a floating right sleeve attached to the right side of said float bed wherein a right cylindrical foam tube can be inserted;

such that when both cylindrical foam tubes are inserted into said device, said device is configured as a raft-shaped flotation aid.

5. The flotation device of claim 4 further comprising a top headrest sleeve wherein one end of a headrest cylindrical foam tube can be inserted therethrough, such that said headrest cylindrical foam tube is approximately centered in said top headrest sleeve.

6. The flotation device of claim 4 further comprising:

a left headrest sleeve attached at a predetermined distance from the left side of the headrest end of said float bed wherein one end of a headrest cylindrical foam tube can be inserted; and a right headrest sleeve attached at a predetermined distance from the right side of the headrest end of said float bed wherein the other end of the headrest cylindrical foam tube can be inserted.

7. The flotation device of claim 6 wherein said right and left headrest sleeves further comprise an endcap attached to each headrest sleeve such that said end caps limit the length of the ends of said headrest cylindrical tube that can be inserted into said left and right headrest sleeves.

8. The flotation device of claim 4 wherein binding tape is used to assemble said float bed, said float sleeves and said headrest sleeves together.

9. A flotation device used to form a flotation aid, which comprises:

a flexible fabric comprising:

a float bed having a headrest end and a bottom end separated by a left side and a right side; and a floating left sleeve attached to the left side of said float bed wherein a left cylindrical foam tube can be inserted; and a floating right sleeve attached to the right side of said float bed wherein a right cylindrical foam tube can be inserted; and a left headrest sleeve attached at a predetermined distance from the left side of the headrest end of said float bed wherein one end of a headrest cylindrical foam tube can be inserted; and a right head rest sleeve attached at a predetermined distance from the right side of the headrest end of said float bed wherein the other end of the headrest cylindrical foam tube can be inserted, such that when all three cylindrical foam tubes are inserted into said device, said device is configured as a raft-shaped flotation aid.

10. A flotation device used to form a flotation aid, which comprises:

a flexible fabric comprising:

a bottom seat having a front end and a back end, separated by two side ends, and;

a seat back having an upper end and a bottom end with two side areas extending from each end, wherein the bottom end is attached to the back end of said bottom seat and the two side areas are likewise attached to the two side ends of said bottom seat to form a chair-shaped structure; and a sleeve, attached to the upper end of said seat back in a predetermined position, said sleeve forming a hollow interior such that inserting a cylindrical foam tube into said sleeve results in said chair-shaped structure providing a chair- shaped flotation device capable of supporting said user.

* * * * *